US006655000B2

(12) United States Patent
Jozaki

(10) Patent No.: US 6,655,000 B2
(45) Date of Patent: Dec. 2, 2003

(54) LOT MANAGEMENT PRODUCTION METHOD AND PRODUCT CARRYING CONTAINER

(75) Inventor: Tomohide Jozaki, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/073,497

(22) Filed: Feb. 11, 2002

(65) Prior Publication Data

US 2002/0121518 A1 Sep. 5, 2002

(30) Foreign Application Priority Data

Feb. 13, 2001 (JP) ..... P2001-034739

(51) Int. Cl.[7] ..... B23P 17/04
(52) U.S. Cl. ..... 29/592; 29/771; 29/791
(58) Field of Search ..... 29/592, 771, 783, 29/791, 429, 430, 469

(56) References Cited

U.S. PATENT DOCUMENTS 5,272,805 A * 12/1993 Akeel et al. ..... 29/712
5,386,621 A * 2/1995 Fluegge et al. ..... 29/705
6,308,496 B1 * 10/2001 Lee et al. ..... 53/154

* cited by examiner

*Primary Examiner*—Gregory Vidovich
*Assistant Examiner*—Stephen Kenny
(74) *Attorney, Agent, or Firm*—Sonnenschein, Nath & Rosenthal LLP

(57) ABSTRACT

A lot management production method in which the lot size is reduced in order to respond to an order for small volume of large variety, without increasing the intermediate inventory and reducing lead-time, however without reducing the productivity of a production of large volume of small variety. Part of the processes in a production line are performed for pieces, or products to be manufactured, in a single lot, while other processes are done for pieces in a group or aggregate of single lots.

10 Claims, 7 Drawing Sheets

LOT MANAGEMENT PRODUCTION METHOD AND PRODUCT CARRYING CONTAINER

CROSS REFERENCE TO RELATED APPLICATIONS

This application claims priority to Japanese Patent Application No. JP 2001-034739, filed on Feb. 13, 2001, and the disclosure of such application is herein incorporated by reference to the extent permitted by law.

BACKGROUND OF THE INVENTION

1. Field of the Invention

The present invention is related to a production method for lot management. Specifically, the present invention relates to a lot management production method for a production line in which there is provided at least one apparatus of each variety of processing apparatuses for each variety of product, and a product-carrying container (for example, a wafer cassette) thereof. In such line, one lot of a designated number of pieces of a same variety/product (for example, a semiconductor wafer) loaded/carried in a carrying container constitutes a minimum unit for consideration. Also, the present invention also relates to a production method and a carrying container thereof, in which production is carried out in large volume of large variety and a whole set of processing steps is performed against each lot according to a sequence corresponding to the variety/product of the lot.

2. Related Art

A wafer process is essential to a semiconductor apparatus manufacturing process and requires a large variety of production processes such as oxidation, resist film coating, exposure, development, etching, diffusion, CVD (Chemical Vapor Deposition), PVD (Physical Vapor Deposition), etc. Such processes are performed on a production line having provided for each variety of product, one or a plurality of apparatuses corresponding to different processing steps.

In addition, a plurality of semiconductor wafers constituting semiconductor apparatuses of different varieties flow through the line on a lot basis. That is, a semiconductor wafer or piece in each lot is transported from a production line to an assembly line after passing through a set of processes according to a sequence determined for a corresponding variety of product to which the piece pertains. A lot is constituted by a predetermined number of semiconductor wafers, for example 24 pieces (alternatively, 25, 50, 100, etc.), and it has been usual practice to perform a whole set of processing steps for each variety, upon loading the number of pieces of semiconductor wafers constituting a lot of, for example, 24 pieces, on a wafer cassette. FIG. 5 schematically shows a lot flow of a conventional wafer processing production line.

In other words, in the conventional related art, each variety of products (herein after referred to simply as "product") passes through a process that is independent from processes of other varieties. For example, a lot A of product "a" in FIG. 5 passes through a process of: Sheet-fed apparatus 1→Batch apparatus 1→Sheet-fed apparatus 101. Such sequence of processes is independent from other lots (lot B, C, etc. in the figure) of other products ("b", "c", etc.). Likewise, the same applies to the other lots B, C, etc. of other products "b", "c", etc. In addition, although a wafer processing production line is conventionally designed for a production of small variety in large volume, there have been attempts to adapt the line for large volume of a large variety. However, even though such attempts have been made for making it possible to realize a production line under large volume of large variety, the efforts have not been done with regard to large volume of small variety, but in order to keep and increase productivity.

However, as integration and downsizing of the semiconductor apparatuses increased, a larger variety of electronic circuits are included in a semiconductor apparatus and assembled in various kinds of electronic appliances. As a result, great progress has been achieved towards improvement of reliability of the electronic appliances, as well as their downsizing, price reduction, improvement of functions, etc., thus the semiconductor apparatuses have expanded their field of application. Consequently, there is an increased request for reduction of lead-time between order and delivery of products.

In other words, there are a considerable number of semiconductor apparatuses in a production line for wafer processing, as it has been described above (FIG. 5 is a schematic representation of a lot processing only for general description purposes, so that an actual line would have tens or dozens of processes). As there may be an assembly process following the wafer process, it is not rare to have a time required from start of production until delivery (a lead-time or lap-time) to be around 1 to 3 months. As a result, the order-issuing side issues an order based on this premise, and planning is conventionally made for manufacturing a product set (a radio, a television image receiver or the like) including the semiconductor apparatus as a component or part. Also, an ordered volume for a semiconductor apparatus of a same type used to be large. For example, it no rarely reached tens of thousands or even millions of pieces per month.

However, as the application for semiconductor apparatuses expanded, the semiconductor apparatuses started to be used also in products of relatively short lifetime as well as products of relatively small volume of production. For example, there is a trend for increasing a sort of order in which it is requested to deliver, for example, 2000 pieces of a designated variety of semiconductor apparatus within a period of 1 month. As a result, the semiconductor manufacturer has to cope with the burden of responding to such kind of request.

In view of such situation, semiconductor manufacturers currently make a forecast for prospective orders and produce in large quantity and keep a large intermediate inventory of a variety of semi-processed products, i.e., unfinished products still in process. Then, the remaining processes are performed accordingly whenever there is an actual order, thus allowing delivery as ordered. According to such procedure, it is supposed that the period of time required from order to delivery is reduced by the amount of time of the processes already performed upon the order forecast with the semi-processed products.

Especially for processes that have larger influence on the production lead-time (or lap-time), there is a strong tendency of producing semi-processed semiconductor wafers in large quantity, thus preparing an intermediate inventory that keeps standing by for prospective orders.

However, keeping large volume of intermediate inventory is not a recommended strategy since, as far as business management is concerned, it is unthrifty and constitutes as negative factor for the management. In addition, it is not rare a case in which the forecasted order has not actually been issued. In such a case, the standing by inventory of semi-processed semiconductors is wasted, causing considerable loss.

Also, once a semiconductor wafer enters an intermediate inventory, it may constitute a factor of oversetting the entire production process, as it is usual practice to perform the production process by giving priority to products having order information of higher accuracy. As a result, such intermediate inventory may give raise to considerable oscillation in production lead-time.

Moreover, if an actual ordered quantity is considerably smaller than lot that used to be of, for example, 24 pieces, the excessive pieces of the lot are turned to intermediate inventory, thus causing increase of the inventory.

As a countermeasure, it is possible to consider reducing the size of the lot of the semiconductor wafer to a fraction of the original lot, such as 6 pieces, for example, while keeping the basic rule of producing the semiconductor wafer by lot throughout all processing steps. By such procedure, as far as small-volume orders are concerned, it is expected that the lead-time required until delivery can be considerably reduced.

As an example, FIG. 6 shows a difference in lap-time (lead-time) according to difference in lot size, by means of a bar graph. Also, a broken line in the figure shows a number of processing apparatuses required according to the size of the lot. Still in FIG. 6, DRY represents dry etching, DIFF represents diffusion, CVD represents Chemical Vapor Deposition, PR represents Photo Resist process, II represents Ion Implantation process, PVD represents Physical Vapor Deposition, CMP represents Chemical Mechanical Polish, MES represents lot flow within the line. As it can be verified in the bar graph of FIG. 6, while in a current situation (current lot: in the example presented, 24 S/L means: 1 lot having 24 wafers; in addition, S means Slice, L means lot and S/L indicates a number of pieces (slices) of semiconductor wafers that constitute one lot) the product having a lap-time of 30 days, the lap-time is 15 days for 12 S/L, 10.2 days for 3 S/L and 9.2 days for 1 S/L, thus the lap-time is reduced proportionally to reduction of the lot size. Accordingly, it can be considered a procedure of reducing lap time by reducing the number of slices of semiconductor wafers in one lot.

Such procedure requires, however, increasing a number of processing apparatuses for keeping the same productivity, as shown in the broken line shown in FIG. 6. Specifically, while the current situation requires 88 machines, the case of 12 S/L requires 153 machines, 6 S/L requires 232 machines and 3 S/L requires 600 machines. This results in reduction of productivity of the production line. In other words, as efficiency of production is reduced as compared to an order for large volume of small variety, such procedure of reducing the size of the lot is not recommended as it hampers efficient utilization of the high productivity that could be attained by the production line.

Although there to be increasing trend towards ordering small volume of large variety, as far as management of production is concerned, there are still orders for large volume of small variety, which cannot be disregarded. Nevertheless, products having such ordering characteristic are products having lots of competitors and, as a result, their unit price is not high, making it unprofitable unless production is carried out with high efficiency. Accordingly, as far as feasibility of the production process is concerned, attempts at promoting productivity of small volume of large variety upon compromising the productivity of the large volume of small varieties may be prohibitive.

In addition, as a way of reducing lead-time, it is possible to consider reducing the lead-time as compared to the current situation, for example shown in FIG. 7A, by performing continuous processing of the lot, as shown in FIG. 7B. FIG. 7A shows a timeline required for a vacuum processing apparatus processing a current lot of, for example, 24 pieces, while FIG. 7B shows a case of reduction of lot to 12 pieces of semiconductor wafers, along with adding a load lock chamber to an existing load lock chamber of the processing apparatus above, thus making the processing chamber related to the apparatus operate under full workload. In other words, the processing shown in FIG. 7B is a case in which there is no spare time in the process performed in the chamber.

Specifically, depressurization is done at the load lock chamber, then the lot is conveyed (or transported) and, upon starting a designated process in the processing chamber, the next lot is depressurized, conveyed and, upon finishing the process, the next lot enters the processing chamber and processed, so that the processing chamber is fully loaded, with no spare time. By doing so, time is achieved in relation to the current situation in FIG. 7A, as it is clearly shown in FIG. 7B.

However, such procedure is not recommended because it requires increasing a number of load lock chambers for the existing processing apparatus, thus increasing the amount of investment required in equipment or machinery of the production line. This is especially true for processing apparatuses requiring depressurization, in which considerable new investment in equipment will be required, pushing the profit and loss break-even point upwards, thus constituting a negative factor for the management performance of the production line.

SUMMARY OF THE INVENTION

The present invention has been conceived in order to alleviate the problems mentioned above by providing a novel lot management production method permitting realization of fast response to an order for small volume of large variety by reducing the lot size (the number of pieces of a product to be processed that constitute one lot) without unnecessarily making the intermediate inventory increase and still reducing the lead-time without affecting the productivity of the production in case a large volume of small variety is ordered. In addition, the present invention has been conceived in order to provide a suitable carrying container for the lot management production method that has been proposed.

A lot management production method according to a first preferred embodiment of the present invention includes processing each piece of product on a single lot basis for part of the processes to be performed in the production line, while for other processes the processing of each piece is performed for an entire group of single lots.

In addition, according to the lot management production method of the first preferred embodiment of the present invention, part of the processes related to production of a small volume in the production line are performed for a single lot, thus reducing the number of pieces to be processed in per lot and allowing reducing the lead-time of the product being produced in small volume. In addition, it is also possible to reduce an excessive production in relation to the ordered volume.

As for other processes, the processing may be performed by aggregating a plurality of lots, thus constituting a lot having an actually increased number of pieces, i.e., increasing the size of the lot and avoiding reducing the productivity in processes related to production of large volume of small variety.

In other words, as production can be performed by processing either a single lot or a group of a plurality of single lots, the resulting effect is that an actual number of pieces in a lot can be adjusted, thus permitting obtaining the advantages of both the reduced number of pieces in a lot and an increased number of pieces in a lot.

A product carrying container according to another preferred embodiment of the present invention carries or contains pieces of products that constitute one lot and, by connecting a plurality of such containers so as to be freely attached or detached to each other, it is possible to constitute a group or aggregate of containers having an effect of a container for carrying a group of lots.

As a result, according to the product carrying container of the second preferred embodiment of the invention, it is possible to utilize the carrying container for either a single lot being processed independently from other lots or joining or combining one container with other containers so as to constitute a container for a group of lots, thus constituting a convenient element for the lot management production method of the first preferred embodiment of the present invention.

BRIEF DESCRIPTION OF THE DRAWINGS

The above and other objects, features and advantages of the present invention will become more apparent to those skilled in the art from the following description of the presently preferred exemplary embodiments of the invention taken in conjunction with the accompanying drawings, in which:

FIGS. 3A and 3B is a schematic view of a connecting structure for connecting a plurality of wafer cassettes, according to the preferred embodiment of the present invention shown in FIG. 2, in which FIG. 3A is a frontal view of a wafer cassette and FIG. 3B is a perspective view of the connecting part;

DESCRIPTION THE PREFERRED EMBODIMENTS OF THE INVENTION

A lot management production method according to a preferred embodiment of the present invention is provided so as to basically perform processing of pieces only on a lot basis for part of the processes that constitute an entire production line, when there is an order for small volume of production. As for the remaining processes, the processing is performed for a group or cluster of a plurality of lots. Although a typical piece in a lot is a semiconductor wafer, the present invention should not be limited to it, so that the present preferred embodiments of the invention may be applied, for example, to a lot management production method for an assembly line of a semiconductor chip after pelletization of the wafer.

Basically, a carrying container according to a preferred embodiment of the present invention is a carrying/conveying/transporting container carrying only pieces to be processed in a production line that constitute one single lot. In addition, a plurality of such containers may be freely attached to and/or detached from each other, so that they may constitute, when combined, a container for the group of lots mentioned above for the remaining processes of the production line. Although a typical example of such group is a wafer cassette, the present invention should not be limited to it.

In addition, although the number of wafers in a lot being 6 S/L (Slices per Lot) and the number of wafer in a group of lots being a multiple of 6 in the preferred embodiment of the present invention mentioned below, the present setting has been done for illustrative purposes only. Also, the scope of application of the present invention should not be limited to wafer processing, but it may be applied for other purposes, for example, assembly of semiconductor chips as well as production processes of products other than semiconductor apparatuses.

Example of Embodiment

Figure 1:
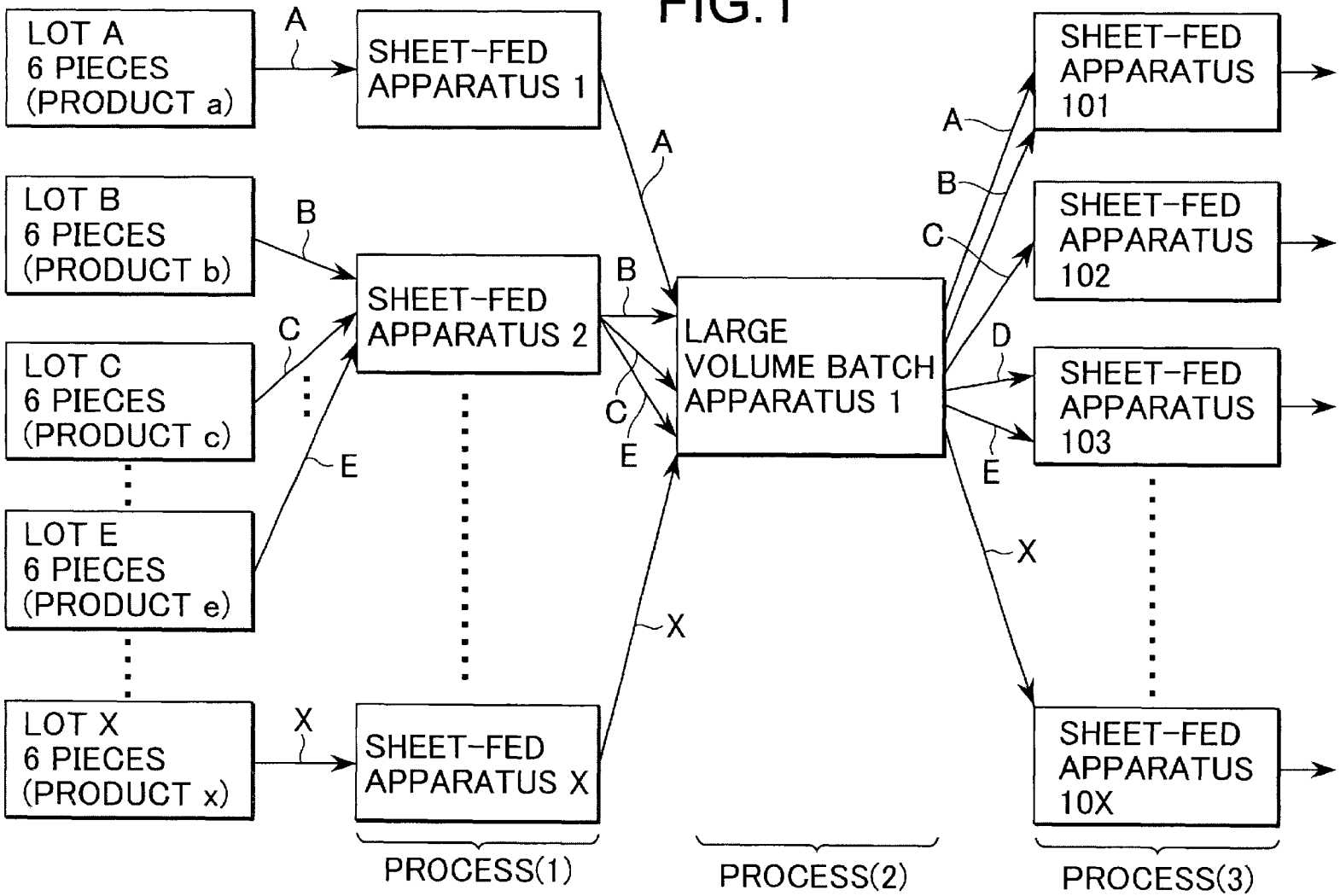
FIG. 1 is a schematic diagram of a lot management production method according to a preferred embodiment of the present invention.
Figure 2:
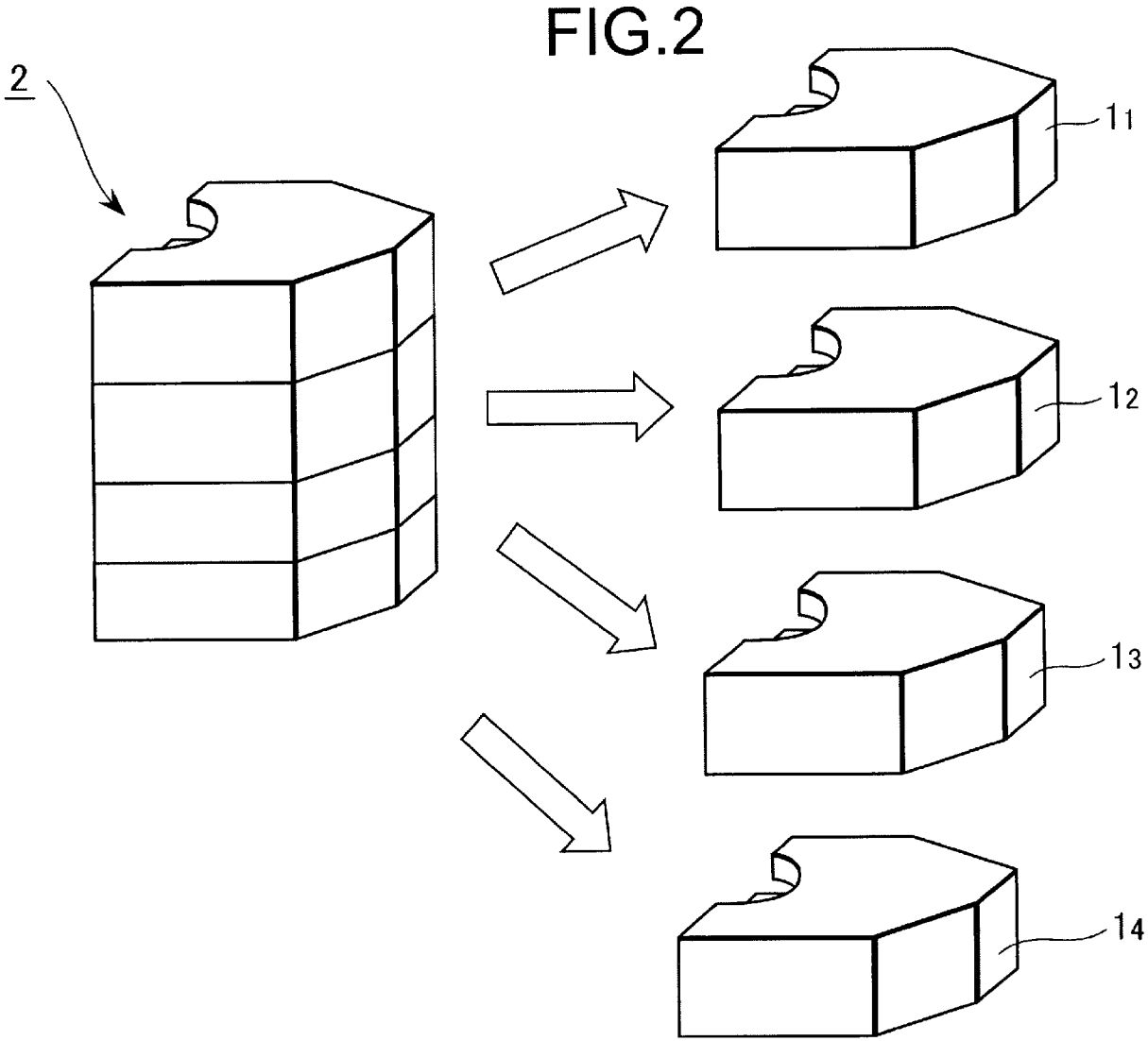
FIG. 2 is a simplified perspective view of a wafer cassette (a processing piece or product carrying container) to be utilized in the lot management production method of the preferred embodiment of the present invention.

A preferred embodiment of the present invention will be present below with reference to the attached drawings. FIG. 1 is a schematic diagram of a first preferred embodiment of a lot management production method according to the present invention, while FIG. 2 is a simplified perspective view of a wafer cassette (a processing piece carrying container) to be utilized in the referred lot management production method.

Figure 6:
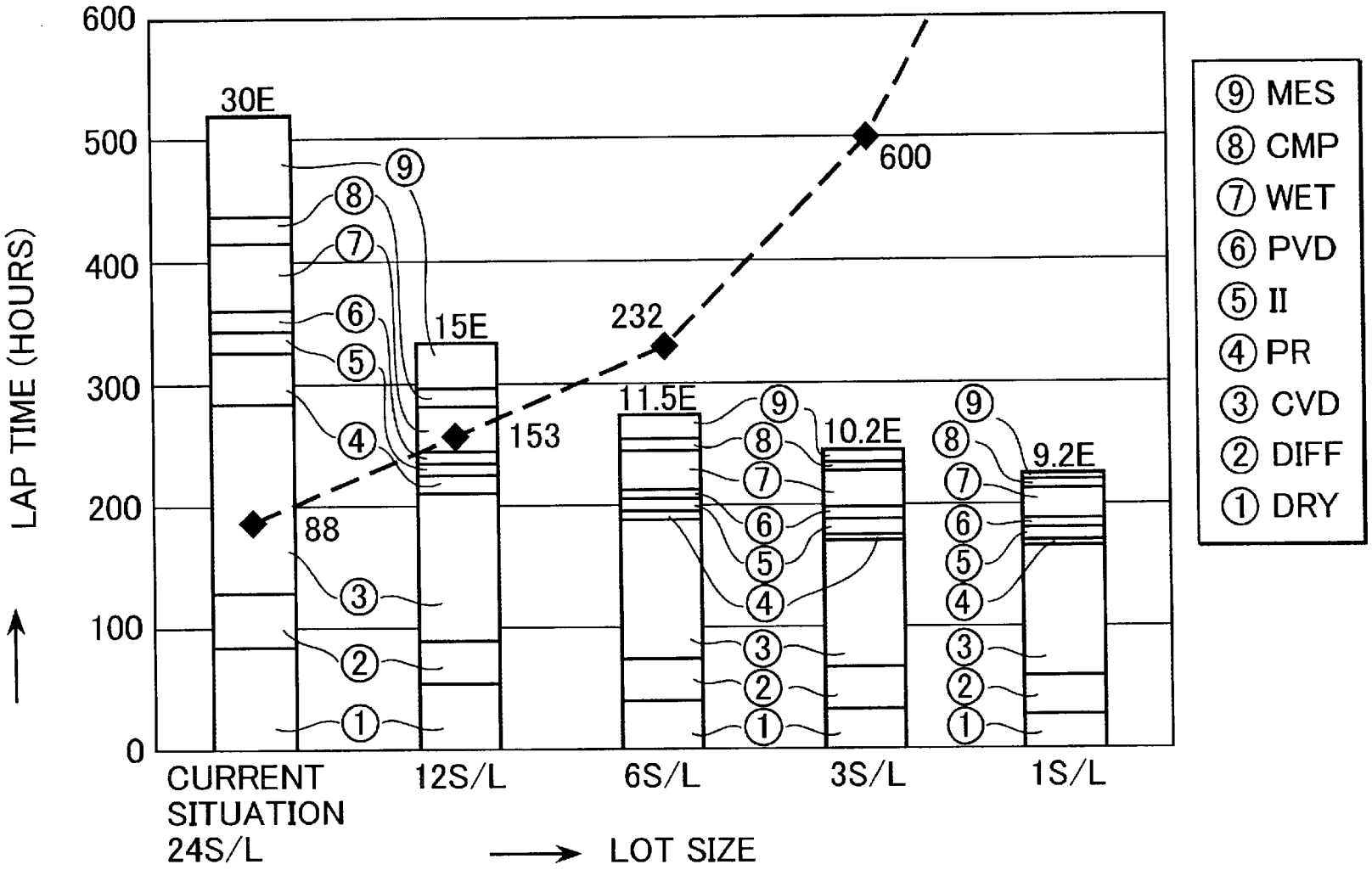
FIG. 6 presents a bar graph showing a relation between lot size and lap-time, and a broken line showing a relation to a required number of machines.
Figure 7:
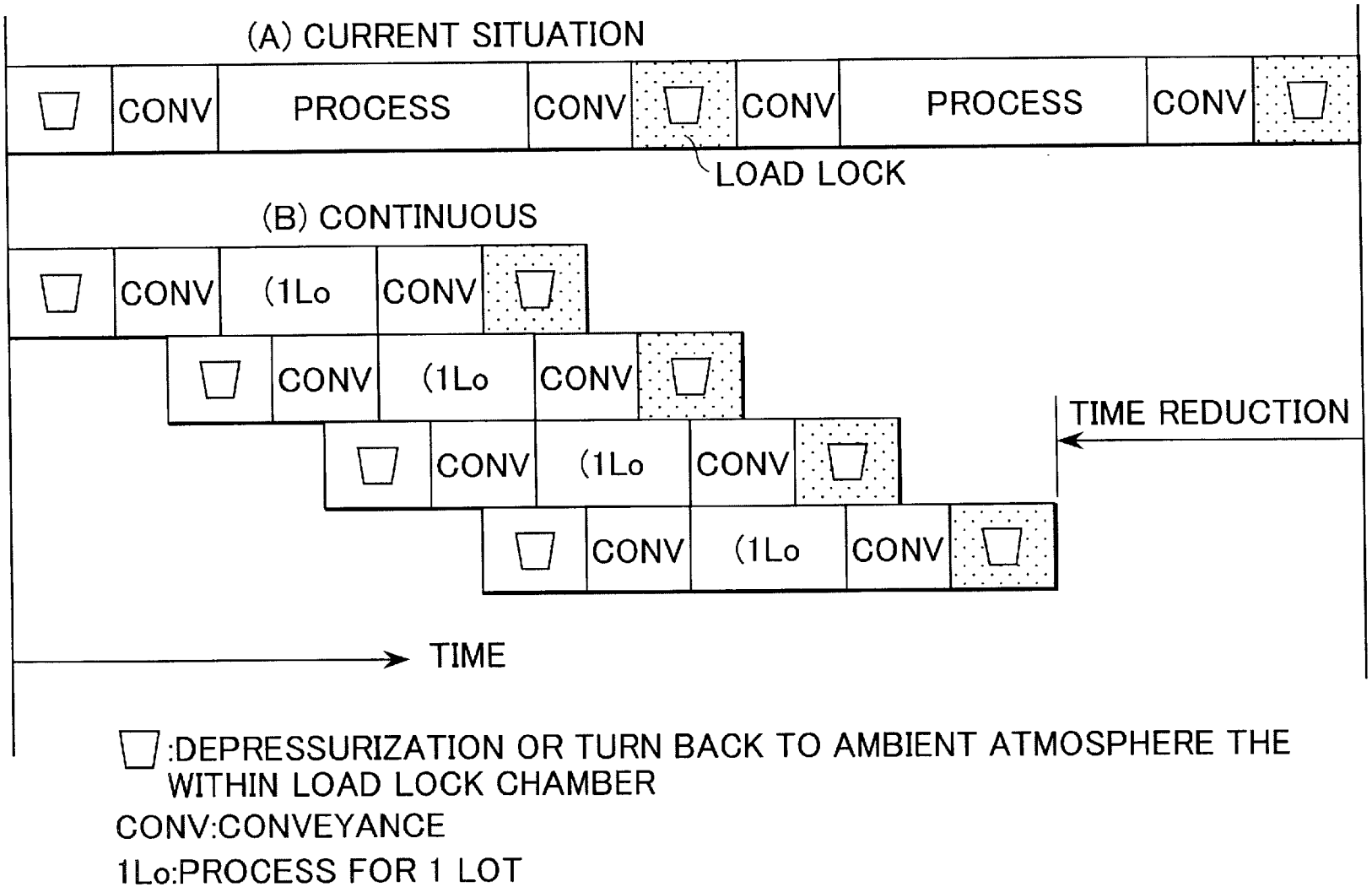
FIG. 7A is diagram showing a time line for the processes for a current situation (conventional method) and FIG. 7B is a diagram showing an example of an alternative method (not adopted in the present preferred embodiment).

The first preferred embodiment of the present lot management production method has a feature in which a number of semiconductor wafer per lot is for example 6 S/L, constituting a quarter of a current lot of 24 S/L. By such procedure, it is possible to reduce a lap-time, thereby allowing fast delivery of a product/variety under small volume, as shown in FIG. 6. Specifically, while in the current case of 24 S/L the lap-time used to be of approximately 520 hours, in the case of 6 S/L, the lap-time is drastically reduced to approximately 270 hours.

The first preferred embodiment of the present lot management production method has a second feature in which part of the processes performed in the production line are performed by combining a plurality of lots of, for example, 6 slices (6S) of semiconductor wafers.

In other words, it is possible to respond to a demand for reducing lap-time of production of small volume of large variety upon reducing the number of semiconductor slices per lot. However, such procedure reduces productivity of a production of large volume of small variety, as well as causing increase in a number of processing apparatuses to be allocated in the production line. In view of such drawback, when a type of process to be performed and conditions for processing of a lot makes it is possible to perform processing of a plurality of lots under same conditions, such plurality of lots are defined as a group (or cluster) of lots and processing is performed for the group of lots as a new unit for the processing.

By such procedure, it is possible to adjust the size of the lot by increments of 6 S/L, like 6 S/L, 12 S/L, 18 S/L, 24 S/L, etc., thus permitting attempts at keeping a level of productivity of the large volume of small variety of products.

The above-mentioned approach allows focusing on Lot A (6S, product "a") of a preferred embodiment of the present invention shown in FIG. 1, in which such lot A is conveyed to a sheet-fed apparatus 1 and processed therein, independent from any other lot. Upon finishing such process, the lot is processed in a large volume batch processing apparatus 1, together with other lots from B to X. When processing for different lots, for example, A to X, can be performed under a same condition, the lots A to X are combined in one group of lots and processed in a large volume batch apparatus like the large volume batch apparatus 1 of FIG. 6, thus the batch processing is done as if the group of lots constituted one single lot.

In addition, after finishing the processing of the large volume batch apparatus, lot A is separated from the other lots C to X and processed in a sheet-fed apparatus 101, however constituting a combined lot with lot B.

Now focusing on product "b" to "e" of lots B to E (4 lots), such 4 lots are first combined and processed in the sheet-fed apparatus 2. Then, lot A as well as lots from F to X are combined to the group of lots B to E and processed in the large volume batch apparatus. Further processes are performed as already described above.

Moreover, lot B is processed at the sheet-fed apparatus 101 as a constituting a group of lots with lot A, as already described above, lot C is processed in sheet-fed apparatus 102 as an independent lot and lots D and E are combined and the combined lots processed in sheet-fed apparatus 103. As for lot X, it is processed independently from other lots, except in the above-mentioned large volume batch processing apparatus 1, in which the lot constitutes the group of lots as already described above.

By such procedure, processes for each lot are performed either as an independent lot, i.e., a single lot, for some processes, or as a group or aggregate of lots in other processes. For instance, as processes of diffusion and cleaning are suitable for large volume batch processing, such processes are performed as batch processes receiving the group of plurality of lots. On the other hand, processes like CVD are normally performed at a sheet-fed apparatus, thus in such case, the process is performed for a unit of a single lot or a group of few lots, from 2 to 4, approximately.

FIG. 2 is a simplified perspective view for describing a wafer cassette to be utilized in the lot management production method shown in FIG. 1. The figure shown in the left side indicates a wafer cassette 2 for carrying a group of a plurality of lots (4 lots) and the right portion of the figure shows wafer cassettes $\mathbf{1}_1$ to $\mathbf{1}_4$ for carrying the lots constituting the group of lots.

Each of such lot-carrying wafer cassettes $\mathbf{1}_1$ to $\mathbf{1}_4$ has a same structure, each can be freely attached/detached from other lot-carrying wafer cassettes so as to constitute a group of lot-carrying wafer cassettes and a number of connected cassettes can be freely increased. Accordingly, the fact that it is possible to process a single lot, or a group of an arbitrary number of lots permit utilization of the lot-carrying wafer cassettes $\mathbf{1}_1$ to $\mathbf{1}_4$ individually and containing the semiconductor wafers constituting the lot, or in group.

Figure 3A:
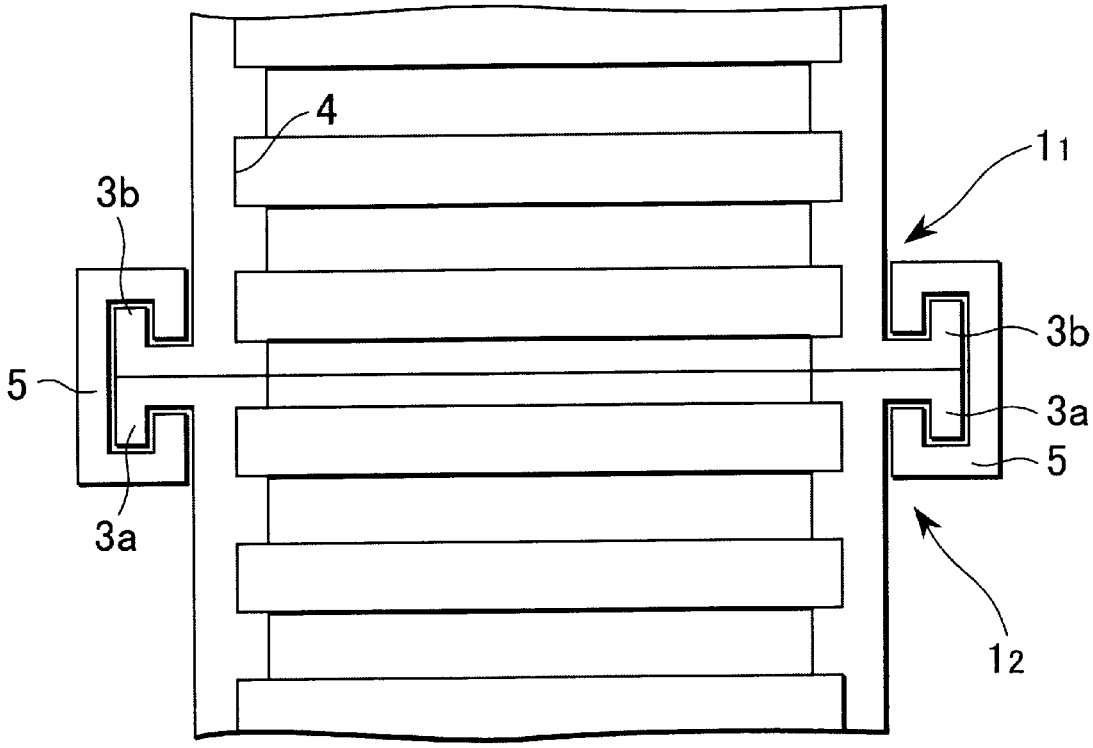
Figure 3B:
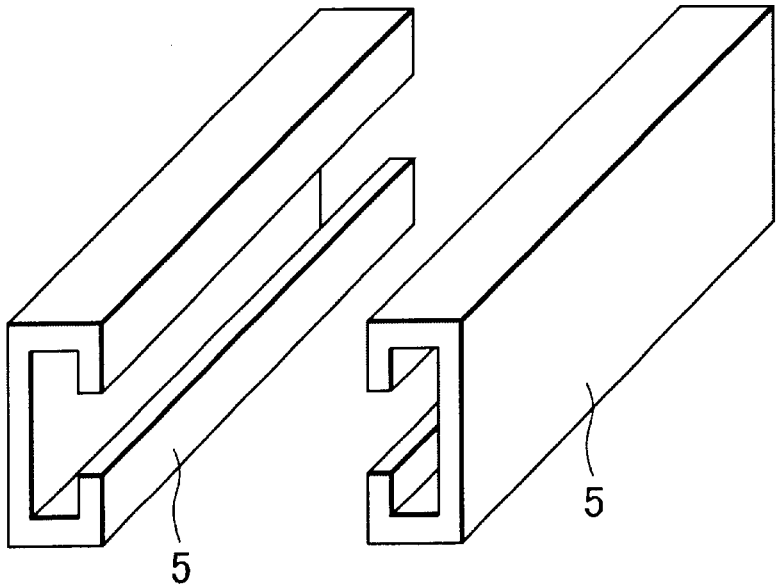

FIGS. 3A and 3B show an example of embodiment of a connecting structure permitting the free attachment/detachment between the lot-carrying wafer cassettes. FIG. 3A is a frontal view of the wafer cassette and FIG. 3B is a perspective view of a pair connecting parts. A wafer cassette 1 is constituted by a material having low gas emission during depressurization, such as a metal of the like. The wafer cassette has a pair of attachment rails 3*a*, 3*a* extending along both upper lateral horizontal edges thereof, as well as a pair of attachment rail 3*b*, 3*b* extending along both lower lateral horizontal edges, as shown in the figure. When superposing a cassette $\mathbf{1}_1$ over another cassette $\mathbf{1}_2$, the bottom surface adjacent to the pair of attachment rails 3*b*, 3*b* of the cassette $\mathbf{1}_1$ faces top surface adjacent to the pair of attachment rails 3*a*, 3*a* of the cassette $\mathbf{1}_2$, like shown in the figure. In addition, when superposing a plurality of cassettes 1, their respective groove portions 4 constitute a vertical array of a plurality of cassettes having a constant groove pitch.

The pair of connecting parts 5, 5 permit keeping a vertical arrangement between cassettes $\mathbf{1}_1$ and $\mathbf{1}_2$ by respectively fitting the pair of attachment rails 3*a*, 3*a* to the pair of attachment rails 3*b*, 3*b* of the respective cassettes $\mathbf{1}_1$ and $\mathbf{1}_2$. By providing the pairs of connecting rails 3*a*, 3*a* and 3*b*, 3*b* on both upper and lower left and right edges of each cassette, as well as keeping the vertical arrangement between superposed cassettes $\mathbf{1}_1$ and $\mathbf{1}_2$ by fitting the pair of connecting parts 5, 5 to the pairs attachment rails 3*a*·3*b*, 3*a*·3*b*, it is possible to easily constitute a wafer cassette 2 of a group of lots constituted by superposing any arbitrary number of cassettes.

Figure 4:
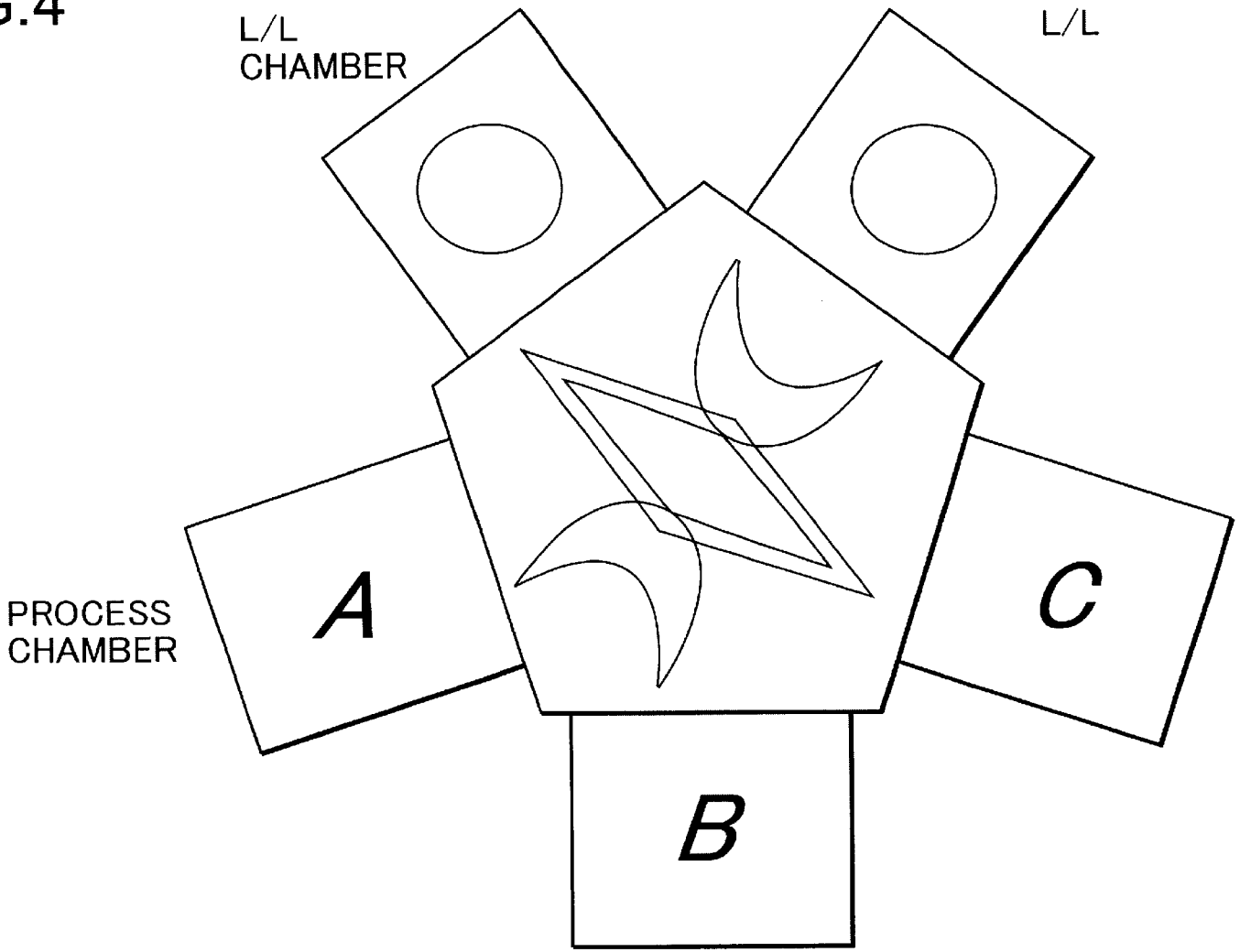
FIG. 4 is a simplified schematic view of a cluster chamber that constitutes an example of processing apparatus to be utilized in the lot management production method according to the preferred embodiment of the present invention.
Figure 5:
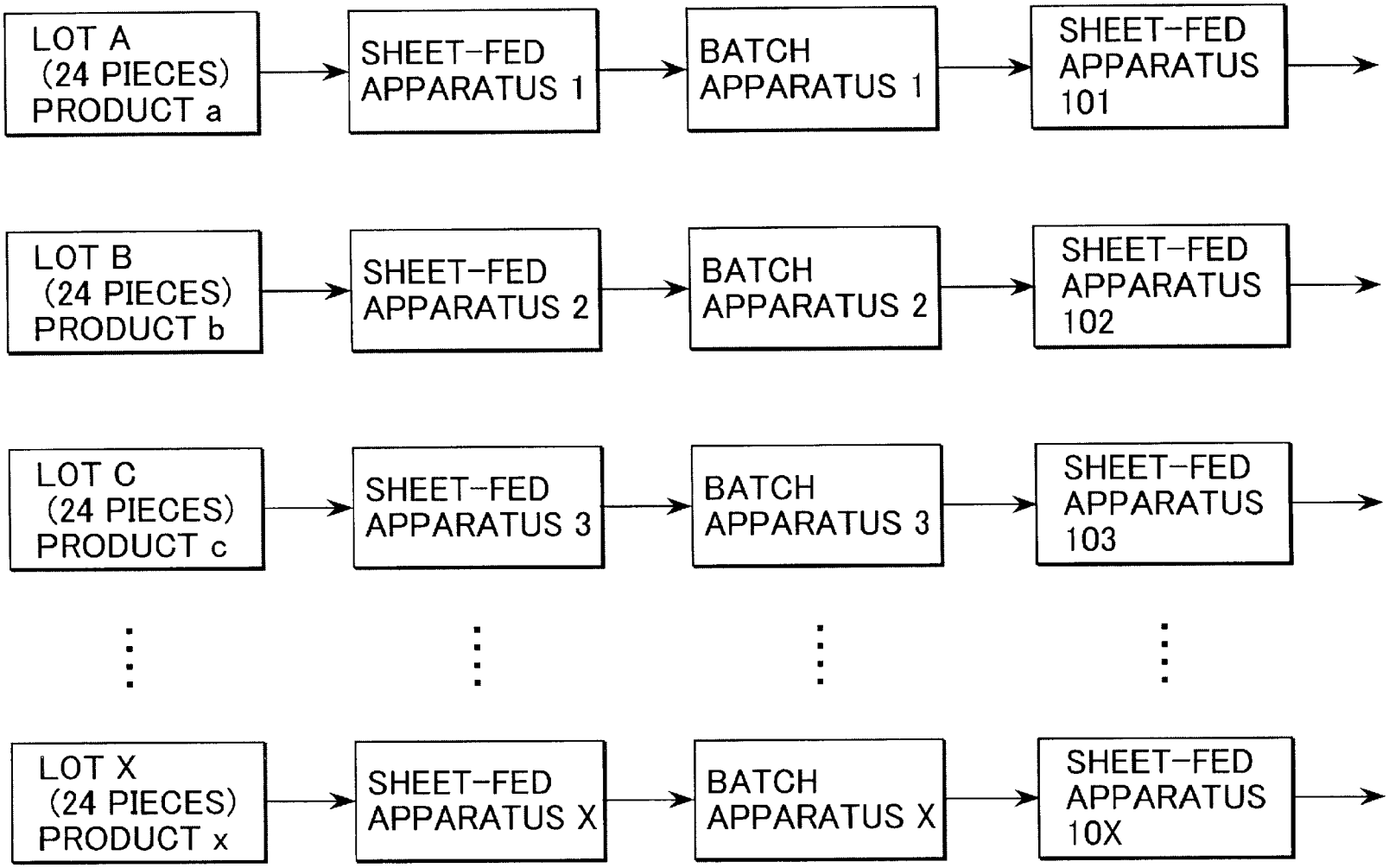
FIG. 5 is a schematic diagram of a conventional lot management production method.

FIG. 4 shows a cluster chamber that constitutes an example of sheet-fed apparatus. Such cluster chamber usually performs sequential loading or unloading of wafers (for example, 24 slices) from containing grooves provided at a constant pitch inside the wafer cassettes. However, as shown in a group structure shown in FIG. 4, by utilizing the cluster chamber upon connecting a plurality of wafer cassettes like shown in FIGS. 3A and B or by using the cassettes in disconnected form, it is possible to perform processing for a single lot or a group of a plurality of arbitrary number of lots, for example 4 lots, without having to reform the process line in order to realize the lot management production method according to the preferred embodiment of the present invention.

Finally, the configurations and structures of respective units and portions described specifically with respect to the preferred embodiments of the present invention are only examples of realization of the present invention, so the embodiments thereof should not be construed as to limiting the technical scope of the present invention. Accordingly, any variations, combinations and sub-combinations of the present preferred embodiments should be permitted without departing from the technical scope of the invention.

What is claimed is:

1. A production method of performing lot management on a production line of a large volume of a large variety of semiconductor wafer products, said production line having at least one of a variety of processing apparatuses, said production method including a series of processes for a lot having a number of pieces of a same semiconductor wafer product contained in a detachable unit of a carrying container as a minimum unit of production, said series of processes performed according to a corresponding semiconductor wafer product, wherein said production method comprises:

processing each piece of semiconductor wafer product in a single lot for a portion of said processes to be performed on said production line, wherein the carrying container has a detachable unit for carrying the single lot, a retaining part for retaining two of said detachable units when aggregated with each other, and wherein a plurality of compartments are uniformly spaced when said detachable units are aggregated to each other and retained by said retaining means; and processing each piece of semiconductor wafer product in a group of said lots for another portion of said processes.

2. The production method of claim 1, wherein the detachable unit of the container has an upper attachment rail extending along an upper lateral horizontal edge of the detachable unit and a lower attachment rail extending along a lower lateral horizontal edge of the detachable unit.

3. The production method of claim 2, wherein the retaining part connects to the upper attachment rail of one of the detachable units and to the lower attachment rail of another of the detachable units and effects a vertical arrangement between the one and the other of the detachable units.

4. The production method of claim 1, wherein the semiconductor wafer products e processed in a cluster chamber.

5. A production method for a production line having a plurality of processing steps, the method comprising:

determining a number of pieces of semiconductor wafers constituting a single lot, based on a number of ordered pieces, wherein a carrying container for carrying a plurality of single lots has a detachable unit for carrying the single lot, a retaining part for retaining two of said detachable units when aggregated with each other, and wherein a plurality of compartments are uniformly spaced when said detachable units are aggregated to each other and retained by said retaining means;

identifying a common processing step for two or more of said single lot, among said plurality of processing steps;

aggregating said two or more single lots having said common processing step, as one aggregated lot;

processing said aggregated lot as a minimum unit for said common processing step; and processing said single lot as a minimum unit for other processing steps in said production line.

6. The production method of claim 5, wherein the detachable unit of the container has an upper attachment rail extending along an upper lateral horizontal edge of the detachable unit and a lower attachment rail extending along a lower lateral horizontal edge of the detachable unit.

7. The production method of claim 6, wherein the retaining part connects to the upper attachment rail of one of the detachable units and to the lower attachment rail of another of the detachable units and effects a vertical arrangement between the one and the other of the detachable units.

8. The production method of claim 5, wherein the semiconductor wafer products are processed in a cluster chamber.

9. A production method of performing lot management on a production line of a large volume of a large variety of semiconductor chips formed from pelletization of one or more semiconductor wafers, said production line having at least one of a variety of processing apparatuses, said production method including a series of processes for a lot having a number of pieces of a same semiconductor chip product contained in a detachable unit of a carrying container as a minimum unit of production, said series of processes performed according to a corresponding semiconductor chip product, wherein said production method comprises:

processing each piece of semiconductor chip product in a single lot for a portion of said processes to be performed on said production line, wherein the carrying container has a detachable unit for carrying the single lot, a retaining part for retaining two of said detachable units when aggregated with each other, and wherein a plurality of compartments are uniformly spaced when said detachable units are aggregated to each other and retained by said retaining means; and processing each piece of semiconductor chip product in a group of said lots for another portion of said processes.

10. A production method for a production line having a plurality of processing steps, the method comprising:

determining a number of pieces of semiconductor chips constituting a single lot, based on a number of ordered pieces, the semiconductor chips wherein a carrying container for carrying a plurality of single lots has a detachable unit for carrying the single lot, a retaining part for retaining two of said detachable units when aggregated with each other, and wherein a plurality of compartments are uniformly spaced when said detachable units are aggregated to each other and retained by said retaining means;

identifying a common processing step for two or more of said single lot, among said plurality of processing steps;

aggregating said two or more single lots having said common processing step, as one aggregated lot;

processing said aggregated lot as a minimum unit for said common processing step; and processing said single lot as a minimum unit for other processing steps in said production line.

* * * * *